US005656187A

United States Patent [19]

Miyamoto et al.

[11] Patent Number: 5,656,187

[45] Date of Patent: Aug. 12, 1997

[54] IMAGE FIXING APPARATUS WITH POWER SUPPLY CONTROL BASED IN PART ON HEATING RESISTOR TEMPERATURE

[75] Inventors: Kazuki Miyamoto, Yokohama; Koki Kuroda, Tokyo; Naoyuki Ohki, Yokohama; Masaki Nakano, Ebina; Takahiro Ushiro; Yasuo Fukazu, both of Kawasaki; Atsushi Chaki, Yokohama; Shinichi Takata, Kawasaki, all of Japan

[73] Assignee: Canon Kabushiki Kaisha, Japan

[21] Appl. No.: 499,815

[22] Filed: Jul. 10, 1995

[30] Foreign Application Priority Data

Jul. 12, 1994 [JP] Japan ..... 6-182816

[51] Int. Cl.[6] ..... H05B 1/00

[52] U.S. Cl. ..... 219/216; 399/336

[58] Field of Search ..... 355/285, 289; 219/216

[56] References Cited

U.S. PATENT DOCUMENTS

| | | | |
|---|---|---|---|
| 4,740,671 | 4/1988 | Kuroda et al. . | |
| 4,891,495 | 1/1990 | Araki . | |
| 5,204,723 | 4/1993 | Hanada et al. | 355/285 |
| 5,210,597 | 5/1993 | Kakiuchi et al. . | |
| 5,262,834 | 11/1993 | Kusaka et al. . | |
| 5,266,774 | 11/1993 | Kimura et al. | 219/216 |
| 5,300,999 | 4/1994 | Koh et al. | 355/289 |
| 5,343,280 | 8/1994 | Hirabayashi et al. | 355/285 |
| 5,365,314 | 11/1994 | Okuda et al. | 355/208 |
| 5,367,369 | 11/1994 | Nakai et al. | 355/285 |
| 5,406,361 | 4/1995 | Kim | 355/285 |
| 5,444,521 | 8/1995 | Tomoyuki et al. | 355/285 |
| 5,471,288 | 11/1995 | Ohtsuka et al. | 355/285 |
| 5,499,087 | 3/1996 | Hiraoka et al. | 355/285 |

FOREIGN PATENT DOCUMENTS

| | | |
|---|---|---|
| 0263653 | 4/1988 | European Pat. Off. . |
| 0373678 | 6/1990 | European Pat. Off. . |
| 0390168 | 10/1990 | European Pat. Off. . |
| 63-31318 | 2/1988 | Japan . |
| 4-44075 | 2/1992 | Japan . |
| 4-204980 | 7/1992 | Japan . |

*Primary Examiner*—R. L. Moses

*Attorney, Agent, or Firm*—Fitzpatrick, Cella, Harper & Scinto

[57] ABSTRACT

An image fixing apparatus includes a resistor for generating heat upon electric energy supply thereto; a temperature sensor for sensing a temperature of the resistor; and a control unit for controlling the electric energy supply to the resistor so that the temperature sensor detects a target temperature, in accordance with both of a temperature of the resistor and a resistance of the resistor.

5 Claims, 8 Drawing Sheets

IMAGE FIXING APPARATUS WITH POWER SUPPLY CONTROL BASED IN PART ON HEATING RESISTOR TEMPERATURE

FIELD OF THE INVENTION AND RELATED ART

The present invention relates to an image fixing apparatus for heat-fixing an unfixed image with heat generated by a resistor.

Image fixing apparatus for heat-fixing the unfixed image with heat produced by heat generating resistor may use a film movable with the unfixed image has been put into practice.

The heating apparatus of the film heating type is disclosed in Japanese Laid-Open Patent Applications Nos. 31318/1988 , 157878/1990 (U.S. Pat. No. 5,262,834), 44075/1992 , 204980/1992 (U.S. Pat. No. 5,210,597), wherein a heat resistive film is pressed by a pressing member against a heater including a heat generating resistor capable of generating heat upon electric energy supply and is moved with the contact therebetween kept. A member or material to be heated is introduced into an image fixing nip formed between the heat resistive film and the pressing roller so that it is fed through the nip together with the heat resistive film, so that the heat from the heater is applied to the material to be heated through the heat resistive film. In an image forming apparatus such as a copying machine, a laser beam printer, a facsimile machine, a microfilm reader-printer, image display apparatus, an unfixed toner image corresponding to the intended information is formed using toner of heat-fusible resin or the like by image forming process means using electrophotographic, electrostatic recording, magnetic recording process on a recording material (electrofacsimile sheet, electrostatic recording sheet, transfer sheet, printing sheet or the like), through direct or indirect transfer process. The unfixed toner image is fixed into a permanent image by the image heating apparatus of the present invention.

The present invention, however, is not limited to the image fixing apparatus, but is applicable to an apparatus for improving a recoding material's surface property such as glossiness or the like by heating the recording material, a drying or heating apparatus while heating a sheet material, or another heating apparatus for heating a material to be heated.

The film heating type heating apparatus is capable of using low thermal capacity of thin film as the heater, and therefore, the power-saving and reduction of the waiting time is accomplished (quick start).

However, in the conventional apparatus, it has been found that even if a predetermined electric energy considered to be required to warm it up in a predetermined period is applied to the resistor, the actual applied electric power lowers due to the resistance change attributable to the temperature rise of the heat generating resistor, with the result of a delay of the rising of the temperature.

SUMMARY OF THE INVENTION

Accordingly, it is a principal object of the present invention to provide an apparatus wherein desired electric energy can be supplied to the resistor despite the change of the resistance of the resistor.

It is another object of the present invention to provide an apparatus in which the warming-up is possible within a predetermined period of time.

According to an aspect of the present invention, there is provided an image fixing apparatus comprising: a resistor for generating heat upon electric energy supply thereto; a temperature sensor for sensing a temperature of the resistor; and control means for controlling the electric energy supply to the resistor so that the temperature sensor detects a target temperature, in accordance with both of a temperature of the resistor and a resistance of the resistor.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
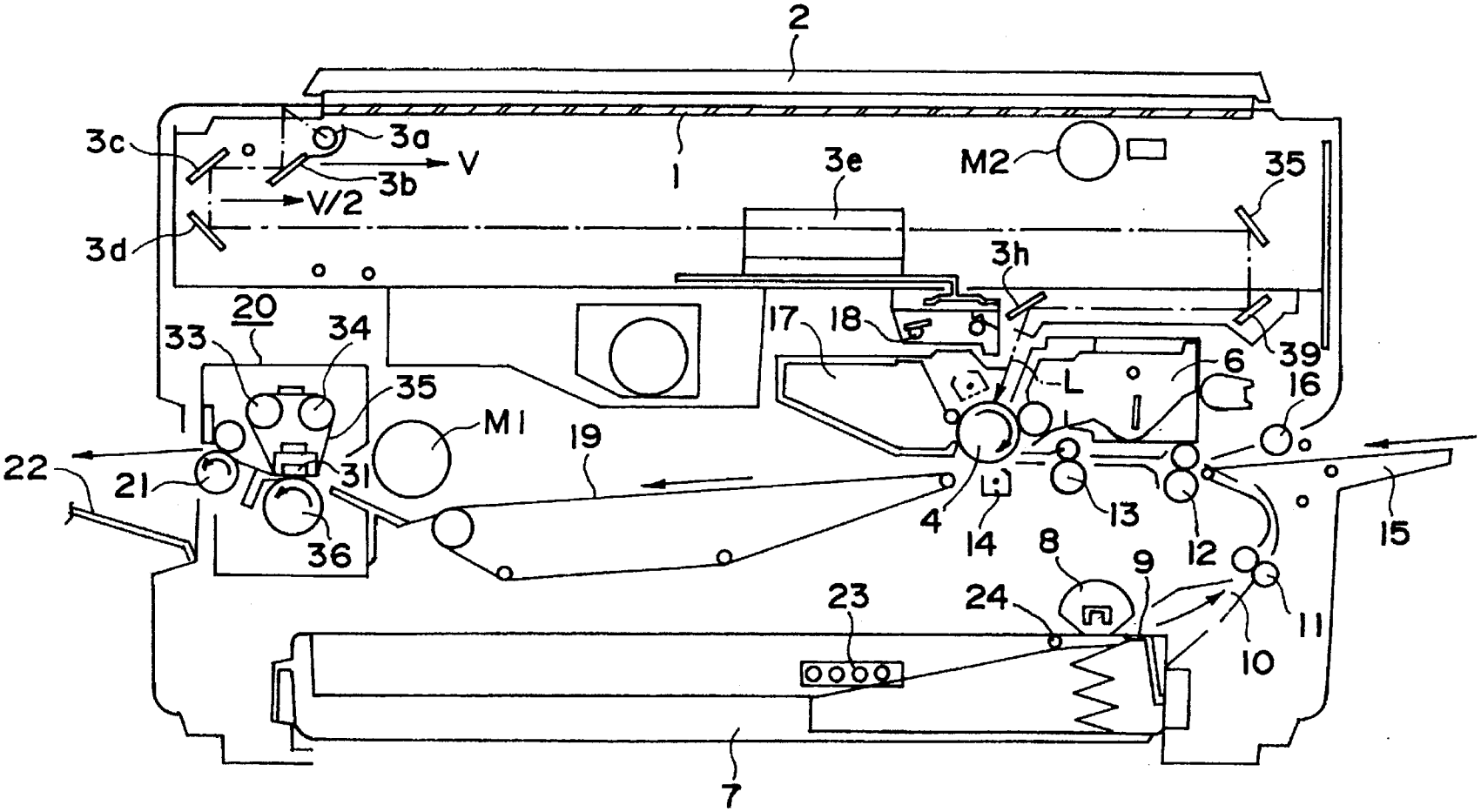
FIG. 1 schematically shows an example of an image forming apparatus provided with an image fixing unit as a heating apparatus according to an embodiment of the present invention.

FIG. 1 shows an example of an image forming apparatus provided with an image heating apparatus as a heating apparatus according to an embodiment of the present invention. The image forming apparatus of this embodiment is a copying machine of image transfer, electrophotographic type wherein an original carriage is fixed and optical system is movable.

Designated by a reference numeral 1 is an original supporting platen glass which is fixed. A sheet having an image to be copied is placed face down on the original supporting platen glass 1 in alignment with a predetermined reference, and an original cover 2 is placed thereon.

In response to copy start signal, an original exposure lamp 3*a* is turned on. The lamp 3*a* and the first mirror 3*b* are reciprocated along the bottom surface of the platen glass 1 from the left home position to the right at a predetermined speed V. Second and third mirrors 3*c* and 3*d* are reciprocated at the speed which is one half (V/2) the speed of the lamp 3*a* and the first mirror 3*b* in the same direction, so that the bottom surface of the original placed on the platen glass 1 is illuminated and scanned from the left to the right. The right reflected by the original surface is imaged through a slit at an exposure position on a drum type electrophotographic photosensitive member 4 rotated at a predetermined peripheral speed in the clockwise direction indicated, through first to third mirrors (movable mirrors) 3*b*, 3*c*, 3*d*, imaging lens 3*e* and fourth to sixth mirrors (fixed mirrors), 3*f*, 3*g* and 3*h*.

The surface of the photosensitive member 4 is uniformly charged to the predetermined polarity and to the predetermined potential by a primary charger 5. The exposure L is effected on the charged surface of the photosensitive member 4, so that an electrostatic latent image is formed corresponding to the image of the original. Subsequently, the latent image formed on the surface of the photosensitive member 4 is developed into a toner image by a developing unit 6.

On the other hand, a transfer material as the recording material is fed from a sheet feeding cassette 7 by cooperation of a pick-up roller 8 and a separation claw 9 one by one. It is fed to an image transfer position at a predetermined timing formed between a transfer unit 14 and the photosensitive member 4, through a sheet passage 10, feeding roller 11, feeding roller 12, registrations rollers 13. Alternatively, a transfer material fed through a multiple manual feeder 15, is introduced to the transfer position at the predetermined timing through the feeding roller 16, conveying roller 12 and registration roller 13. By doing so, the toner image is sequentially transferred onto the surface of the transfer material from the surface of the photosensitive member 4.

The transfer material having passed through the transfer position is separated from the surface of the photosensitive member 4, and is introduced to an image fixing unit (image heating apparatus, image heat fixing apparatus) 20 which will be described in detail hereinafter, on a belt of the feeding unit 19. In the image fixing apparatus, the toner image is heated and fixed, and then is discharged as a copy to the outside discharging tray by the sheet discharging rollers 21.

After the transfer of the toner image onto the transfer material, the surface of the photosensitive member 4 is cleaned by a cleaning unit 17 so that the residual matters such as untransferred or the like is removed. Additionally, the residual potential is removed by a pre-exposure lamp 18 so as to be prepared for the repeated image formation.

A DC brushless motor M1 functions to drive the sheet feeding station, conveying station, photosensitive member, the fixing station or the like. A stepping motor M2 functions as a driving source for the optical system (including the mechanism for reading the image). The stepping motor M2 a phase excitation signal to be applied to each phase A, A*, B, B* for the stepping motor M2 is produced. In the excitation system of this embodiment, the mode of the motor M2 is switched between two-phase excitation mode and 1–2 phase excitation mode on the basis of speed information set to the load.

The sheet feeding system is operable in two modes in one of which the sheet is fed from sheet feeding cassette 7, and in the other of which the sheet is fed from a multiple manual sheet feeder 15. In the case of the sheet feed from the cassette 7, the operation is controlled by switches 23 for detecting presence or absence of the cassette 7 and for detecting sizes of the transfer material in the cassette 7, and a switch 24 for detecting presence or absence of the transfer material in the cassette 7. When an abnormal state is detected by the switches 23 and 24, the display is effected on the display portion to that effect. In the case of use of multiple manual feeder, the operation is controlled by a switch for detecting the state of the manual feeder 15, and when abnormal state is detected, the display is effected on the display portion to that effect.

Figure 2:
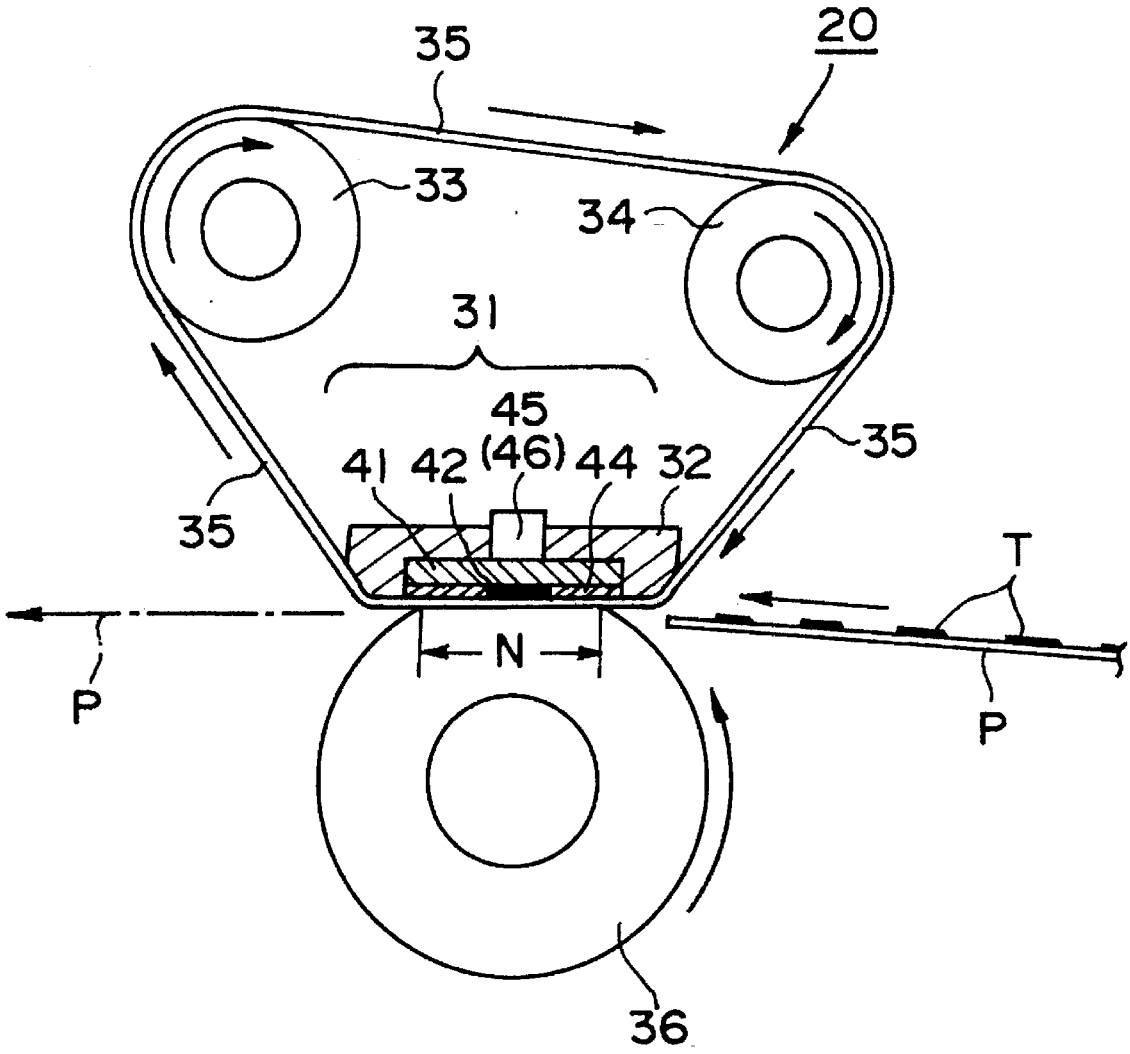
FIG. 2 is a side view of the image fixing unit.
Figure 3:
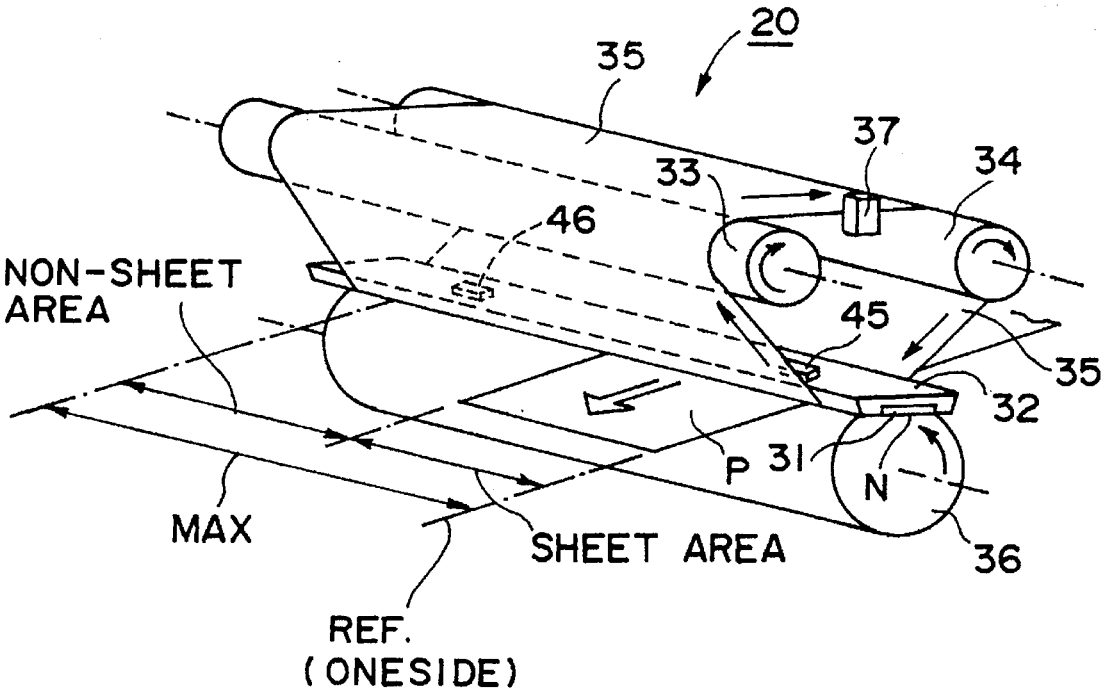
FIG. 3 is a perspective view of the image fixing unit.
Figure 4:
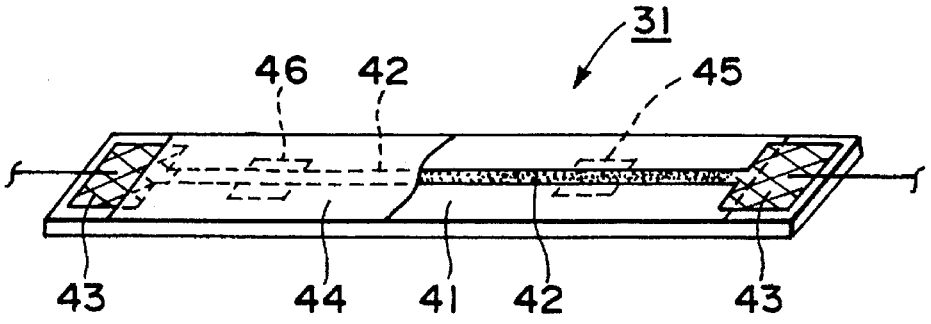
FIG. 4 is a partly broken perspective view of a heater.

The image fixing unit 20 of this embodiment is a film heating type heating apparatus. FIG. 2 is a side view of the structure of the fixing unit 20, FIG. 3 is a perspective view, and FIG. 4 is a partly broken perspective view of the heater.

Designated by a reference numeral 31 is a heater, and is fixedly supported on the bottom surface of a supporter 32 of heat resistive plastic material with the heat generating surface facing down. A film driving roller 33 and a tension roller 34 are substantially in parallel with the supporter 32. A heat resistive film 35 (fixing film) in the form of an endless belt is extended around the supporter 32, and the rollers 33 and 34.

A pressing roller is urged to the bottom surface of the heater 31 with the fixing film therebetween. Designated by N is a fixing nip formed between the heater 31 and the pressing roller 36 with the fixing film 35 therebetween. The pressing roller 36 has a rubber elastic layer having high parting property such as silicone rubber or the like. It is urged to the bottom surface of the heater 31 with a total pressure of 4–10 kg.

The fixing film 35 is rotated at a predetermined peripheral speed in the clockwise direction by the clockwise rotation of the driving roller 33. The predetermined speed is substantially equal to the feeding speed of the transfer material P the material to be heated introduced into the fixing unit 20 by the feeding unit 19 (FIG. 1) from the toner image transfer station described above. The fixing film 35 travels without crease, snaking movement or delay with or without correction control. The pressing roller 36 is driven by the fixing film 35. Designated by a reference numeral 37 (FIG. 3) is a movement detecting element or a movement regulating member for the lateral shift of the film, provided in an unshown lateral shift controlling mechanism.

When the fixing film 35 is rotated while the heater 31 generates heat, the transfer material P is introduced into the fixing nip N between the fixing film 35 and the pressing roller 36. Then, the transfer material P is gripped and fed together with the film 35 with close contact with the surface of the fixing film 35, and the heat from the heater 31 is applied to the transfer material through the fixing film 35, so that the toner image T on the transfer material is heated and fixed on the surface of the transfer material P. The transfer material P having passed through the fixing nip N is separated from the surface of the rotating fixing film 35 by the radius of curvature.

The fixing film 35 is repeatedly used for the heating and fixing of the toner image, it has high heat resistivity, high parting property, high durability or the like. Generally, the total thickness is small, for example, not more than 100 μm, preferably not more than 40 μm.

The fixing film 35 may be of single layer from of a heat resistive resin material such as polyimide, polyether imide, PES, PFA (tetrafluoroethylene perfluoroalkylvinylether copolymer). Alternatively, it is a multi-layer film comprising 20 μm thick film and a coating layer at least on the side contactable to the transfer material, the coating material being PTFE (tetrafluoroethylene resin), PAF or another fluorine resin added with electroconductive material. The coating layer has a parting property and a thickness of 10 μm.

As shown in FIGS. 2 and 4, the heater 31 is a generally low thermal capacity linear heater comprising a heat resistive, electroinsulative and heat-conductive base plate 41 which is an elongated member extending in a direction substantially perpendicular to the movement of the transfer material P or fixing film 35, a heat generating resistor 42 formed along the length of the base plate 41 substantially at the center of the width thereof, electric energy supply electrodes 43 for the heat generating resistor 42 at longitudinally opposite ends, and a heat resistive overcoating layer 44 for protecting the surface of the heater having the heat generating resistor 42.

The heater 31 is fixed on the supporter 32 with the bottom surface having the heat generating resistor 42 faced down.

The supporter 32 is of highly heat resistive resin material such as PPS (polyphenylene sulfide), PAI (polyamide imide), PI (polyimide), PEEK (polyether ether ketone), liquid crystal polymer or the like, or a compound material of the above material and ceramics, metal, glass or the like.

The heater base plate 41, for example, is an electrically insulative and thermally conductive material of alumina or aluminum nitride or the like having a thickness of 1 mm, a width of 10 mm and a length of 240 mm. The heat generating resistor 42 is screen-printed pattern layer of Ag/Pd, $RuO_2$, $Ta_2N$ or the like, for example (resistor material having a width of several mm, a thickness of several tens um). The electric power supply electrodes 43 are of Ag, Cu, Au or the like, and is an electroconductive material pattern layer. The coating layer 44 is of heat resistive glass or the like.

A voltages applied across the electrodes 43 and 43 to supply electric energy through the heat generating resistor 42, so that the heat generating resistor 42 generates heat. The temperature of the heater 31 including the heat generating resistor 42 is quickly increased.

The plastic material supporter 32 is reinforced by means of metal stay. To the metal stay, first and second temperature sensors (thermisters) 45 and 46 for detecting the temperature of the heat generating resistor 42 through the base plate 42 are mounted to directly contacted to the back side (heater base plate back side) of the heater 31.

The first temperature sensor 45 is disposed on the heater backside at a position corresponding to a longitudinal area of the heater corresponding to the sheet passage area of the minimum transfer material among the sizes of the usable material (the area which is the sheet passage area for any sizes). The second temperature sensor 46 is disposed corresponding to the sheet non-passage area when a small size transfer material is used. Thus, it is disposed on the back side of the heater at a position away from the reference side for the sheet passage (the is fed in alignment with one lateral reference side in this embodiment).

When a small size transfer material is passed through the nip, the temperature of the heater in the non-passage area increases, and therefore, the second temperature sensor 46 detects the high temperature to increase the interval of the transfer materials continuously fed.

By the electric energy supply to the heat generating resistor 42 of the heater 31, the heat generating resistor 42 generates heat to quickly increase the temperature of the heater substantially over the entire length thereof. The rise of the temperature is detected by the first temperature sensor 45, and the sensed temperature is fed back to the temperature control system, and the electric energy supply to the heat generating resistor 42 is controlled so as to maintain the predetermined fixing temperature of the heater side 1.

Figure 5:
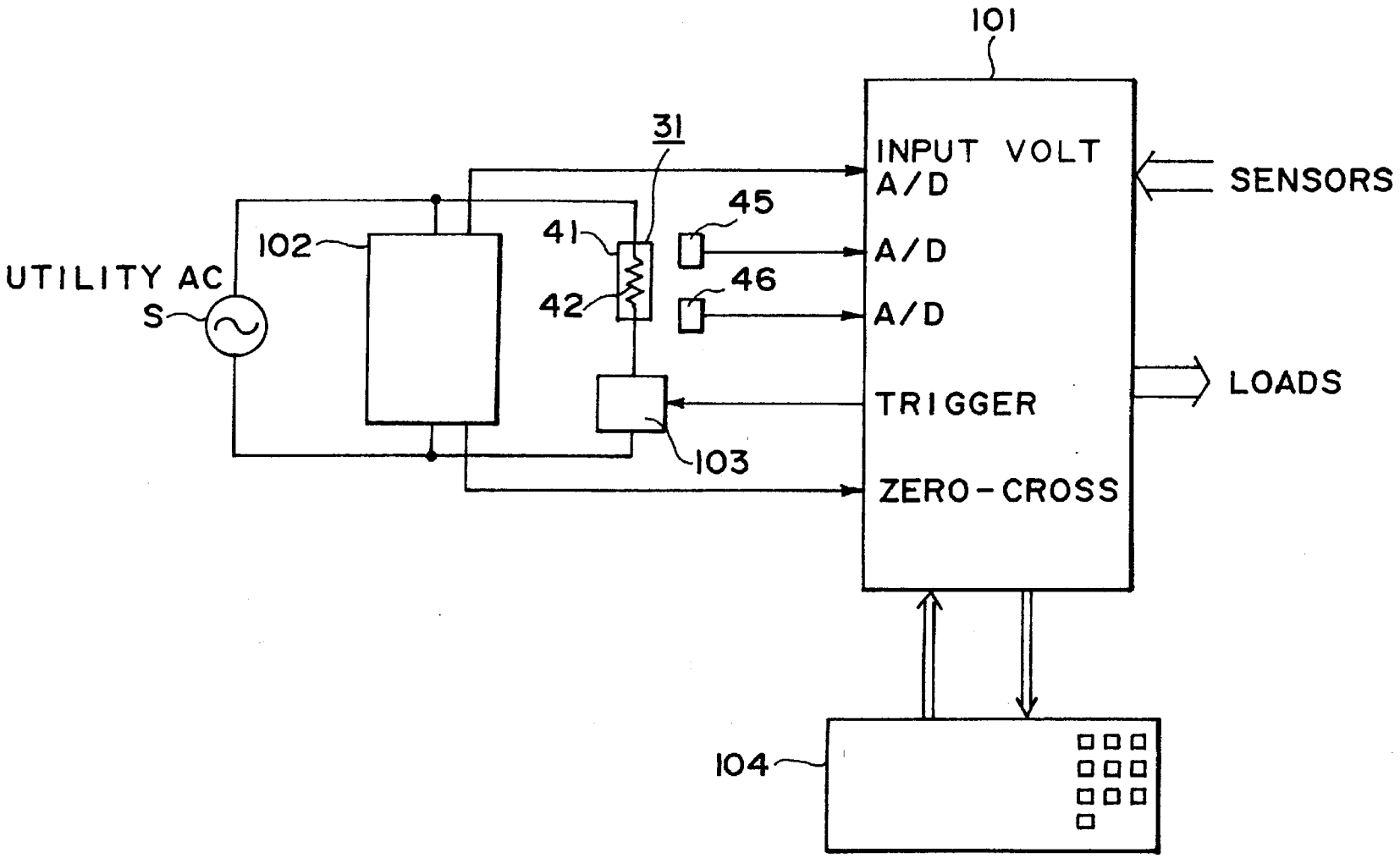
FIG. 5 is a block diagram of a heater controller.

FIG. 5 is a block diagram of a heater controller.

Designated by a reference numeral 101 is a controller (CPU) for controlling the temperature and the electric power supply to the heater side 1. The controller 101 comprises calculating means for calculating a voltage to be applied to the heat generating resistor 42, temperature control means for controlling the electric energy supply so that the temperature sensor 46 senses a predetermined temperature, correcting means for correcting the resistance of the heat generating resistor on the basis of a temperature-resistance coefficient of the heat generating resistor and the temperature of the heat generating resistor and for correcting the voltage to be applied on the basis of the corrected resistor.

Designated by a reference numeral 102 is a circuit for detecting utility AC source S as the electric energy supply means and input voltage.

A switching circuit 103 switches the voltage to be applied to the heat generating resistor 42 of the heater 31. The voltage to be applied to the heater 31 (42) is switched in accordance with the sensed temperature by the controller 101.

The controller 101 supplies the AC input voltage from the input voltage detecting circuit 102 to A/D of the controller 101. This is the root mean square value E of the input voltage.

The outputs of the temperature sensors (thermisters) 45 and 46 are also supplied to A/D of the controller 101. The resistance of the heat generating resistor 42 of the heater 31 has already been determined under normal temperature (reference temperature) condition. This is stated on the fixing unit 20. The resistance is inputted in non-volatile memory using an operator 104.

A zero-cross signal is produced on the basis of AC input, and is supplied to the controller 101 as an interruption signal. A trigger Signal functions as a timing signal for phase-controlling the electric energy supply to the heat generating resistor 42 of the heater 31.

The heater 31 is formed by printing the heat generating resistor material on the ceramic base plate 41, and therefore, it is excellent in thermal responsivity. Therefore, if the electric energy supply to the heat generating resistor 42 is on-off-control in a usual manner, the temperature ripple is too large, or the heater 31 is over-powered, with the possibility of damage to the heater 31. Therefore, the electric power supply control of this embodiment is such that the heat generating resistor is supplied with constant electric energy. In order to reduce the ripple, the electric energy supply to the heater 31 is switched in accordance with the heater temperature sensed by the first temperature sensor 45.

The description will be made as to the electric energy supply control to the heater 31. The electric energy supply to the heater 31 is also effected through phase control similarly to the control for the exposure lamp 3*a*. The heat generating resistor 42 is a pure resistance load, and therefore, the electric power or energy W is:

$$W=V_H^2/R$$

where $V_H$ is the voltage applied to the heat generating resistor, and R is a resistance of the heat generating resistor.

The reference resistance R of the heat generating resistor 42 involves relatively large variations due to manufacturing error, and therefore, it is stored in the non-volatile memory for each of the image forming apparatus or image fixing unit. Since the electric energy to be supplied in accordance with the temperature of the heat generating resistor is known, the voltage $V_H$ to be supplied to the heat generating resistor is:

$$V_H^2=R\times W \quad (1)$$

From the equation of the root mean square voltage, the voltage $V_H$ to be applied to the heat generating resistor 42 is:

$$V_H = \sqrt{\frac{\int_{TH}^{T/2} E^2 \max \mathrm{SIN}^2(2\pi/T)tdt}{T/2}} \quad (2)$$

$$V_H^2 = Erms^2\,(1 - (2\,T_H/T) + (1/2\pi)\mathrm{SIN}(4\pi T_H/T))$$
$$Erms^2/V_H^2 = 1/\{1 - 2 \times T_H/T + \mathrm{SIN}(4\pi T_H/T)/2\pi\}$$

From equation (1), $V_H^2$ is calculated, and the value E (root mean square)$^2$ from the value provided by the AC input voltage detecting circuit 102, and then $E^2/VH_H^2$ is calculated. By equation (2), the time period $T_H$ (corresponding to the voltage to be applied) from the zero-cross signal to the trigger signal to the heater 31, can be determined. In this embodiment, $T_H$ is determined from $E^2/V_H^2$ using a table.

Through the above-described process, the electric energy supply control to the heater 31 is carried out. The electric energy control to the heater 31 is carried out during the copying operation to provide the constant temperature of the heater 31.

Figure 6:
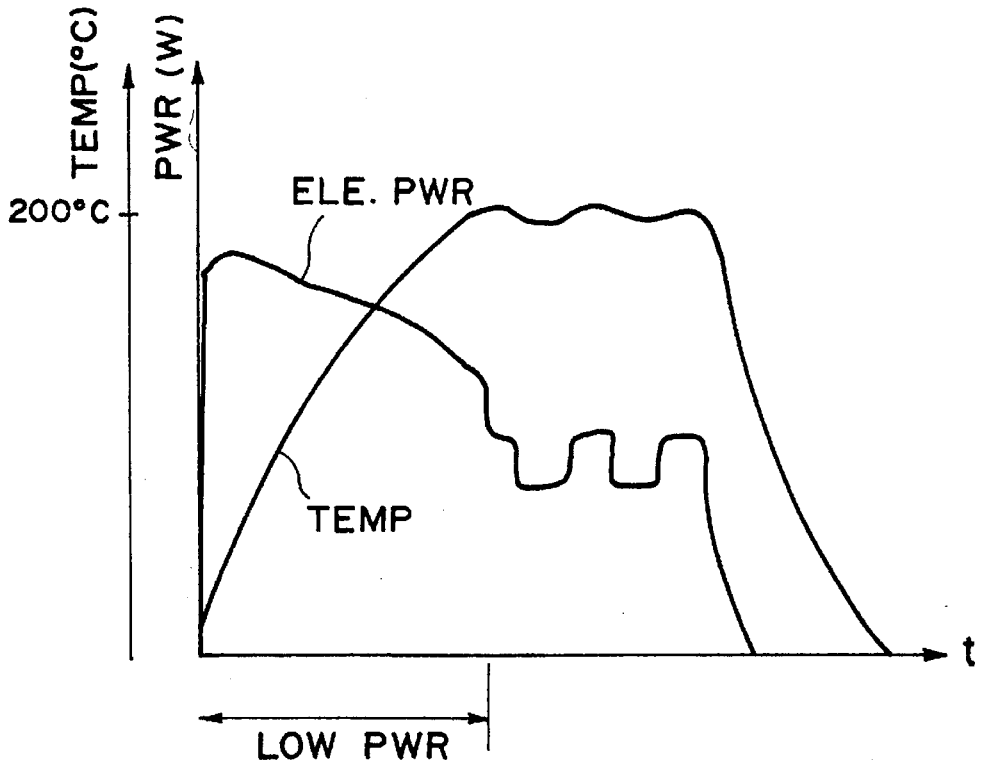
FIG. 6 shows energy-time characteristics of the heat generating resistor before correction on the basis of the resistance.

On the other hand, with the rising of the temperature of the heater 31, the resistance of the heat-generating resistor 42 increases. With the increase of the resistance, the electric energy applied to the heat generating resistor 42 gradually decreases since the voltage applied $V_H$ is constant. This is shown in the electric energy-time characteristics in FIG. 6. The supplied electric energy decreases when the maximum electric energy is applied.

Thus, the electric energy supply decreases with increase of the temperature of the heater, and therefore, the temperature does not reach the target temperature within a desired time period. Particularly, under low temperature ambience, proper image fixing property is not expected. For example, the voltage $V_H$ applied by the time period $T_H$ of the trigger signal from the zero-cross signal is $(1000\times7.2)^{1/2}$=84.8 V, when the target electric energy W=1000 W, the resistance R is 7.2 ohm. and target temperature of the heat generating resistor is 200° C.

However, actually, the resistance of the heat generating resistor changes with the change of the temperature of the heater. When the temperature of the heater is 200° C., the temperature difference is 200–20=180° C. (20 is normal temperature) since the resistance-temperature coefficient of the heat generating resistor of this embodiment is 400 ppm /° C. when the temperature of the heater is 200° C., the change of the resistance value is 400×180=72000 ppm. Therefore, the resistance is approx. 7.72 ohm. For this reason, the electric energy to be applied when the temperature is around 200° C., is $84.8^2/7.72$=931 W, although the target electric energy is 1000 W.

Figure 7:
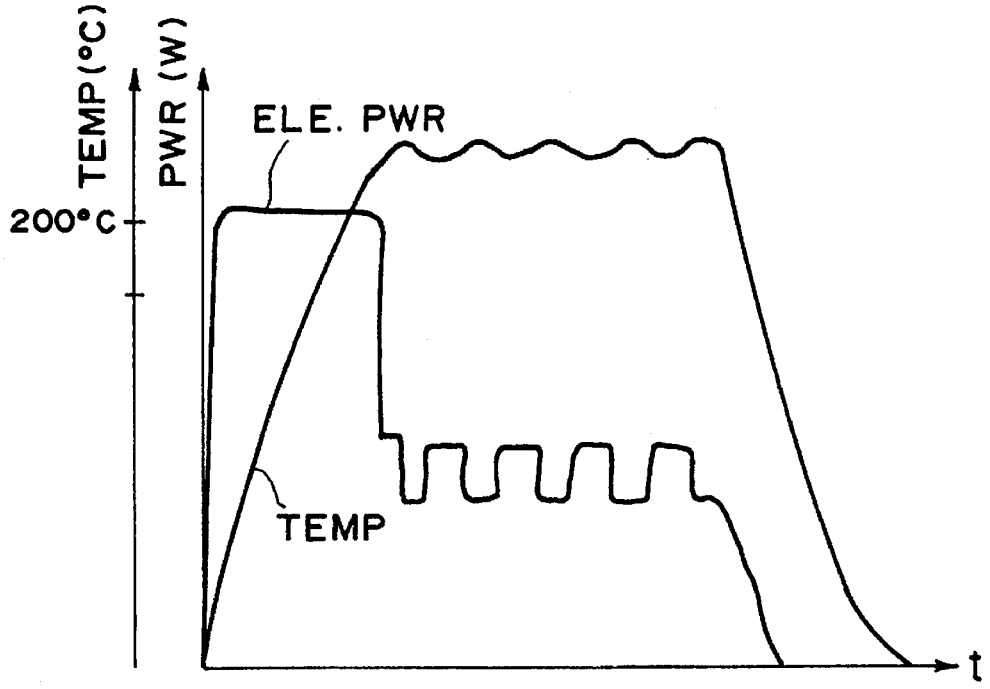
FIG. 7 shows energy-time characteristics of the heat generating resistor after correction on the basis of the resistance.

Therefore, it is desirable that the heater resistance is corrected on the basis of the resistance-temperature coefficient and the temperature detected by the thermister. In this embodiment, in order to simplify the electric energy supply control circuit, the resistance is determined at the target temperature when the voltage to be applied to the heater is determined. And, the determined value is used. FIG. 7 shows the results of correction. As will be understood, the warming-up period up to the target temperature is improved.

Referring to FIGS. 8 and 9A to 9D, the correcting process for the voltage to be applied will be described.

In the heater electric energy calculation routine, a temperature sensed by a first temperature sensor (thermister) 45 and A/D value of the input voltage E(rms) are read, and on the other hand, the corrected resistance R'is determined (step S152) in accordance with the stored resistance, the resistance-temperature coefficient and the target temperature.

Figure 8:
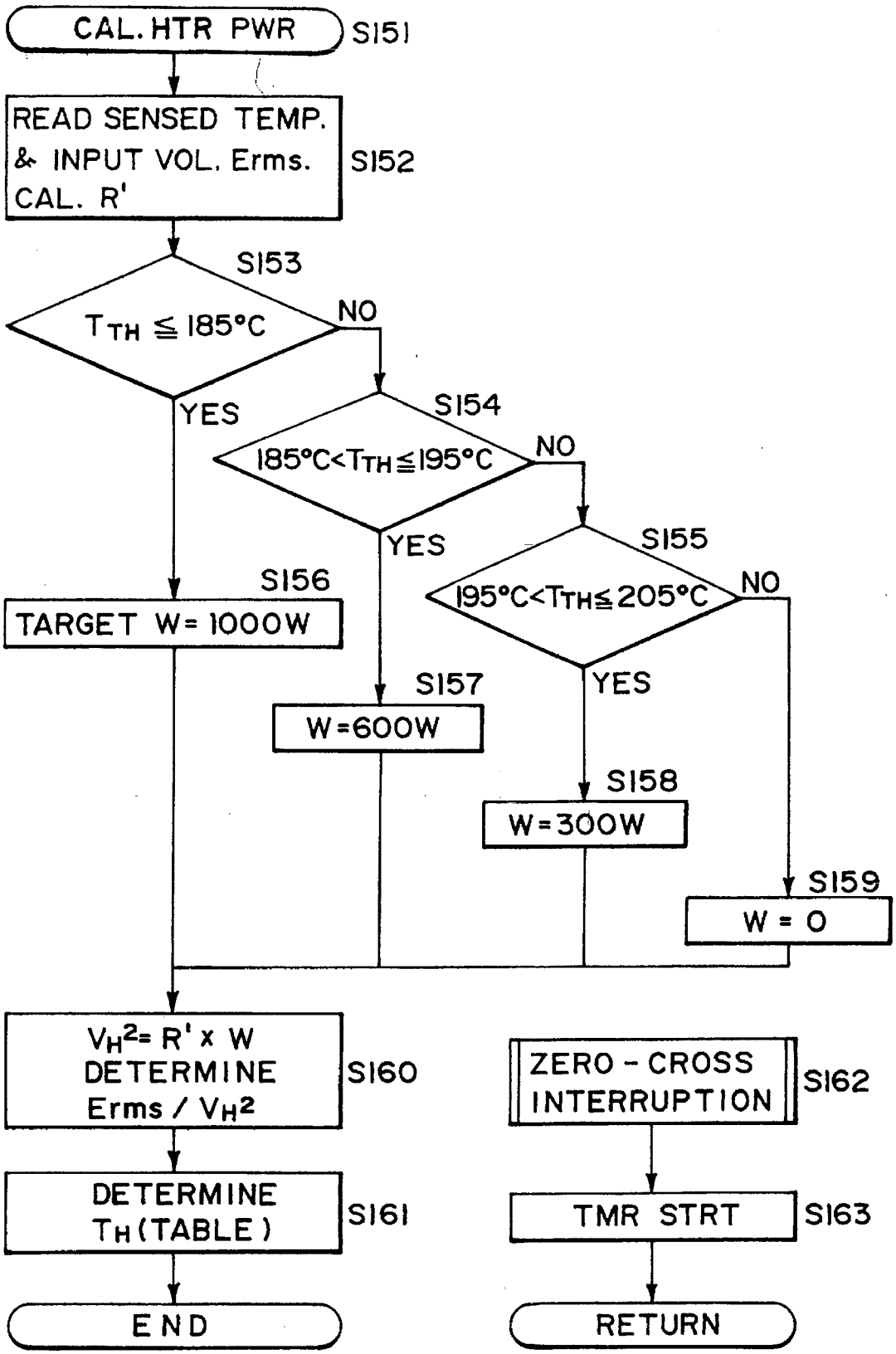
FIG. 8 is an electric energy controlling flow chart.
Figures 9A, 9B, 9C, 9D:
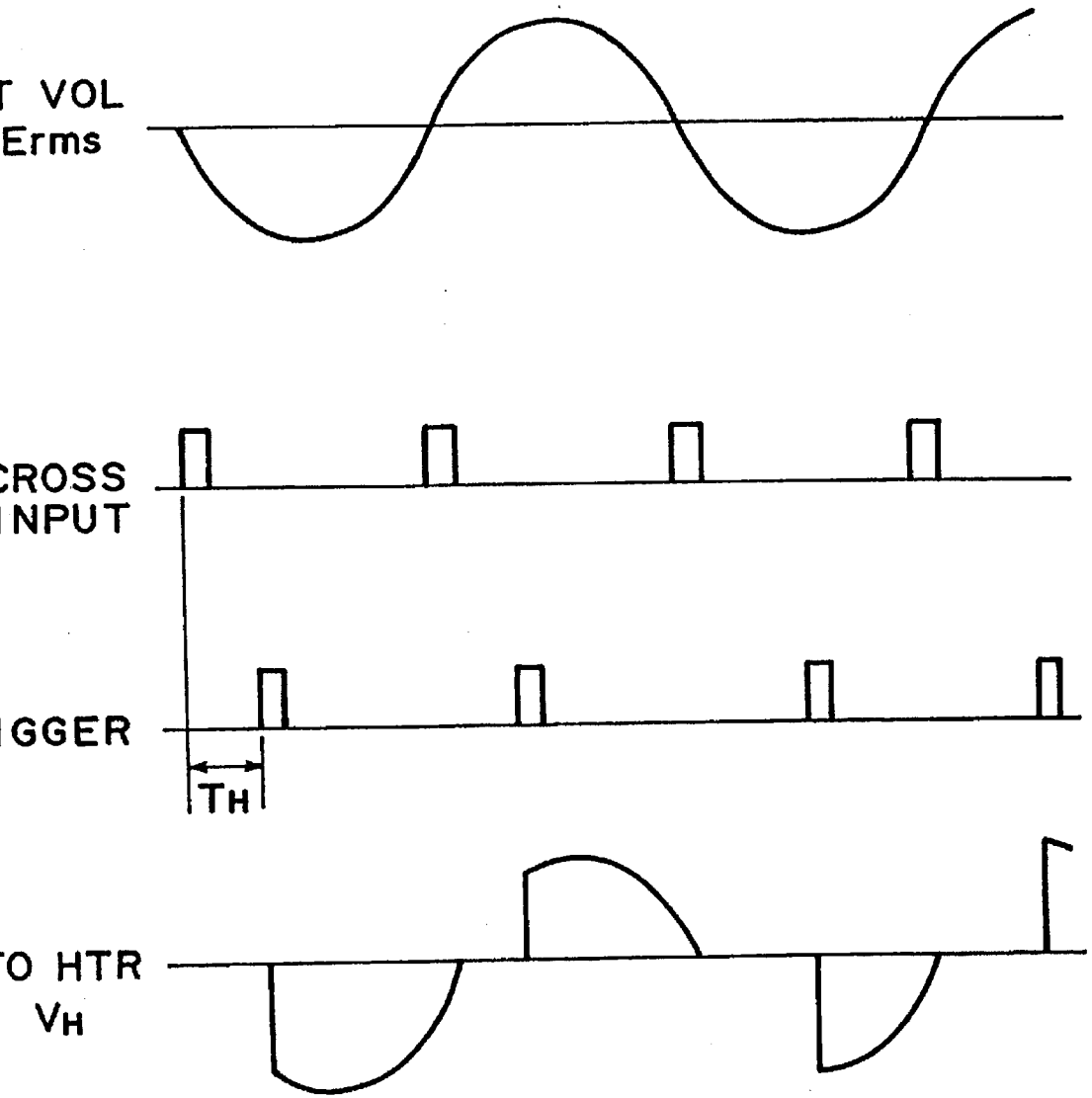
FIGS. 9A–9D is a timing chart of the electric energy supply.

In this embodiment, the target applied electric energy is changed on the basis of the temperature detected by the first temperature sensor 45 (FIG. 8). The target voltage is determined on the basis of the current temperature (S153–S159). In order to respond to the variation of the input voltage, the applied electric energy is changed also in response to the input voltage.

When the target applied electric energy W is determined, $V_H^2$=W×R×R' is determined using the target applied electric power W and the corrected resistance R'. Subsequently, $E(rms)^2/V_H^2$ (S160) is determined. Beforehand, the relationship between the time period $T_H$ and $E(rms)^2/V_H^2$ is determined on the basis of equation (2), and the results are stored in the form of a table. By the use of the table with $E(rms)^2/V_H^2$, the time period $T_H$ corresponding to the voltage in accordance with the corrected resistance, can be determined (S161).

Upon the production of the zero cross interruption signal, a timer for outputting the trigger signal $T_H$ is started (S162, S163). When the time period $T_H$ elapses from the zero cross point, the phase control is carried out to supply the electric energy (FIGS. 9A–9D). In this manner, the electric energy supply to the heat generating resistor is controlled in accordance both with the temperature of the heat generating resistor and the resistance thereof, and therefore, the electric energy supply is sufficient even if the temperature of the heat generating resistor rises, thus permitting sufficient warming-up during a desired time period. In the foregoing embodiment, the correction of the heater resistance is carried out only at the target temperature. However, it is possible to correct for each temperature sensing by the first temperature sensor 45. This permits further correct electric energy supply control.

The structure of the image fixing apparatus is not limited to the ones described in the foregoing. The following is examples of other structures of the apparatus.

Figure 10A:
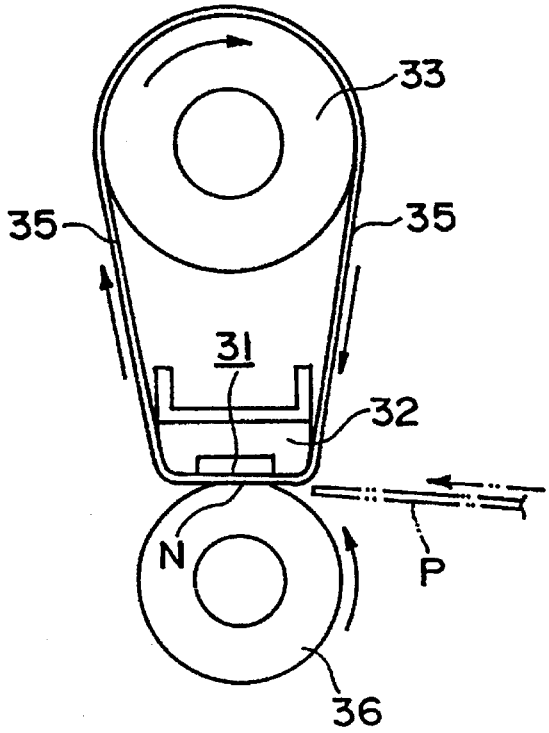
FIGS. 10(*a*)–(*c*) shows further examples of film heating type heating apparatus.
Figure 10B:
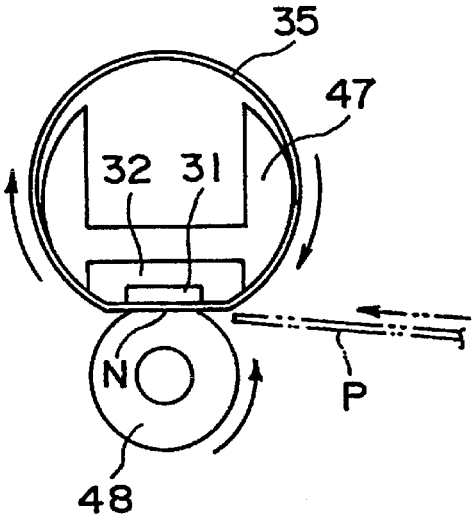
Figure 10C:
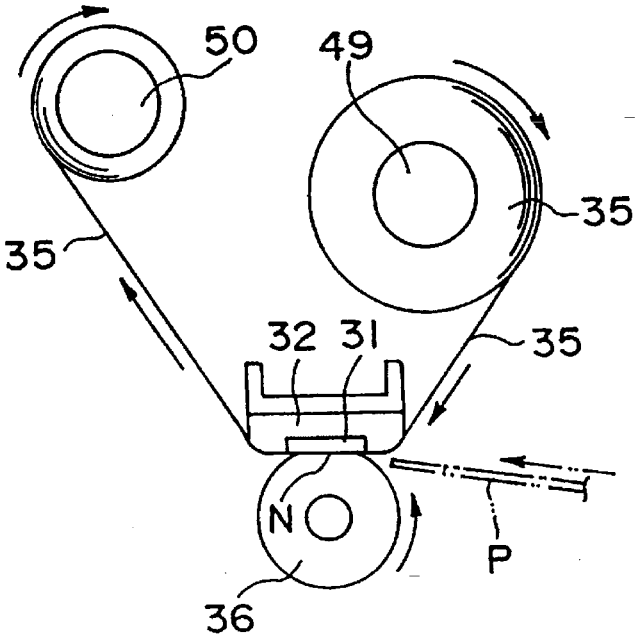

FIG. 10 shows other examples of the film heating type heating apparatus.

FIG. 10, (*a*) shows an example in which an endless belt heat resistive film 35 is stretched around the heater 31 and the driving roller 33, and the film 35 is rotated by the driving roller 33.

In FIG. 10, (*b*), a cylindrical heat resistive film 35 is loosely extended outside the heater 31 and a film guide 47 supporting the heater 31. The film 35 is press-contacted to the heater 31 by the pressing roller 48. By rotating the pressing roller 48, the film 35 is driven (pressing roller driving type) while the inside surface of the film 35 is in sliding contact with the surface of the heater 31.

FIG. 10, (*c*) shows an example in which the heat resistive film 35 is not an endless belt type, but is a non-endless film having a large length and rolled. The film is supplied out from a supply shaft 49 and is taken up through a heater 31 on a take-up shaft 50 at a predetermined speed.

In the foregoing embodiments, the description has been made as to a heating apparatus of a film heating type. However, the present invention is not limited to a heating apparatus, but is applicable to a heating roller type, if the material to be heated is heated by a heater including a heat generating resistor generating heat upon electric energy supply. The electric energy supply to the heat generating resistor can be properly controlled.

As described in the foregoing, according to the present invention, the electric energy supply to the heat generating resistor is increased or decreased in accordance with the change of the resistance of the heat generating resistor due to the temperature rise thereof so that the electric energy supply to the he generating resistor can be properly controlled, for example, constant despite the resistance change due to the temperature rise of the heat generating resistor. By doing so, the electric energy supply is prevented from reducing due to the resistance increase due to the temperature rise of the heat generating resistor, thus improving the temperature rising. In an image heating apparatus, proper image fixing property is maintained.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus comprising:

a resistor for generating heat upon electric energy supply thereto, wherein a resistance of said resistor increases with an increase in a temperature thereof;

a temperature sensor for sensing a temperature of said resistor;

control means for controlling the electric energy supply to said resistor so that said temperature sensor detects a target temperature, in accordance with both of a temperature of said resistor and a resistance of said resistor.

2. An apparatus according to claim 1, wherein said control means comprises a correction circuit for correcting a voltage to be applied to said resistor in accordance with the temperature of said resistor, in accordance with the resistance of said resistor.

3. An apparatus according to claim 1, wherein said control means switches a voltage to be applied to said resistor in accordance with an input voltage.

4. An apparatus according to claim 1, further comprising an input portion for inputting the resistance of said resistor at a reference temperature, and said control means controls the voltage to be applied with accordance with the input.

5. An apparatus according to claim 1, further comprising a film movable together with a recording material carrying an unfixed image so that the unfixed image is heated by said resistor through said film.

* * * * *

UNITED STATES PATENT AND TRADEMARK OFFICE

CERTIFICATE OF CORRECTION

PATENT NO. : 5,656,187
DATED : August 12, 1997
INVENTOR(S) : Kazuki MIYAMOTO, et al.

It is certified that error appears in the above-identified patent and that said Letters Patent is hereby corrected as shown below:

Column 1, line 16, after "44075/1992", insert a comma (",");
Line 17, delete the comma (","), first occurrence;
Line 42, delete "recoding" and insert therefor --recording--.

Column 2, line 33, delete "is" and insert therefor --comprise--;
Line 35, delete "10(a)-(c)" and insert therefor --10A to 10C--;
Line 35, delete "shows" and insert therefor --show--.

Column 5, line 30, delete "plate 42" and insert therefor --plate 41--.

Column 6, line 29, delete "Signal" and insert therefor --signal--.

Column 7, line 64, delete "R′is" and insert therefor --R′ is--.

Column 8, line 35, delete "is" and insert therefor --are--;
Line 67, delete "he" and insert therefor --heat--.

UNITED STATES PATENT AND TRADEMARK OFFICE

CERTIFICATE OF CORRECTION

PATENT NO. : 5,656,187

DATED : August 12, 1997

INVENTOR(S) : Kazuki MIYAMOTO, et al

It is certified that error appears in the above-identified patent and that said Letters Patent is hereby corrected as shown below:

Column 10, line 15, delete "with", first occurrence, and insert therefor -- in --.

Signed and Sealed this

Twenty-eighth Day of April, 1998

Bruce Lehman

*Attest:*

BRUCE LEHMAN

*Attesting Officer*

*Commissioner of Patents and Trademarks*